US012167753B2

(12) United States Patent
Rogan et al.

(10) Patent No.: US 12,167,753 B2
(45) Date of Patent: Dec. 17, 2024

(54) AEROSOL GENERATING ARTICLE, A METHOD FOR MANUFACTURING AN AEROSOL GENERATING ARTICLE AND AN AEROSOL GENERATING SYSTEM

(71) Applicant: JT International S.A., Geneva (CH)

(72) Inventors: Andrew Robert John Rogan, Forres (GB); Lubos Brvenik, Krpelany (SK)

(73) Assignee: JT International S.A. (CH)

( * ) Notice: Subject to any disclaimer, the term of this patent is extended or adjusted under 35 U.S.C. 154(b) by 1023 days.

(21) Appl. No.: 17/052,427

(22) PCT Filed: May 15, 2019

(86) PCT No.: PCT/EP2019/062496
§ 371 (c)(1),
(2) Date: Nov. 2, 2020

(87) PCT Pub. No.: WO2019/224073
PCT Pub. Date: Nov. 28, 2019

(65) Prior Publication Data

US 2021/0084981 A1 Mar. 25, 2021

(30) Foreign Application Priority Data

May 21, 2018 (EP) ..... 18173398
May 21, 2018 (EP) ..... 18173404
(Continued)

(51) Int. Cl.
*A24F 40/465* (2020.01)
*A24C 5/01* (2020.01)
(Continued)

(52) U.S. Cl.
CPC ..... *A24F 40/465* (2020.01); *A24C 5/01* (2020.01); *A24D 1/20* (2020.01); *A24F 40/20* (2020.01)

(58) Field of Classification Search
CPC ..... A24F 40/20; A24F 40/465; A24D 1/20; A24C 5/01
See application file for complete search history.

(56) References Cited

U.S. PATENT DOCUMENTS

2015/0013696 A1 1/2015 Plojoux et al.
2015/0245669 A1 9/2015 Cadieux et al.
(Continued)

FOREIGN PATENT DOCUMENTS

CN 103997922 A 8/2014
CN 105768240 A 7/2016
(Continued)

OTHER PUBLICATIONS

International Search Report including Written Opinion for PCT/EP2019/062496 mailed Sep. 10, 2019; 13 pages.
(Continued)

*Primary Examiner* — Katherine A Will
(74) *Attorney, Agent, or Firm* — Lerner David LLP

(57) ABSTRACT

An aerosol generating article includes aerosol generating material having first and second regions and an inductively heatable susceptor in the first region. The first region can be located upstream of the second region or downstream of the second region relative to an aerosol flow direction within the article. A method for manufacturing an aerosol generating article and an aerosol generating system are also described.

17 Claims, 14 Drawing Sheets

(30) Foreign Application Priority Data

| | | |
|---|---|---|
| May 21, 2018 | (EP) | 18173406 |
| Jun. 8, 2018 | (EP) | 18176708 |
| Jun. 8, 2018 | (WO) | PCT/EP2018/065155 |
| Nov. 29, 2018 | (EP) | 18209147 |

(51) Int. Cl.
*A24D 1/20* (2020.01)
*A24F 40/20* (2020.01)

(56) References Cited

U.S. PATENT DOCUMENTS

| | | | | |
|---|---|---|---|---|
| 2015/0282525 | A1 | 10/2015 | Plojoux et al. | |
| 2017/0027226 | A1 | 2/2017 | Mironov et al. | |
| 2017/0055575 | A1 | 3/2017 | Wilke et al. | |
| 2017/0055576 | A1 | 3/2017 | Beeson et al. | |
| 2017/0055580 | A1 | 3/2017 | Blandino et al. | |
| 2017/0055582 | A1 | 3/2017 | Blandino et al. | |
| 2017/0086508 | A1* | 3/2017 | Mironov | A24F 40/46 |
| 2017/0105452 | A1 | 4/2017 | Mironov et al. | |
| 2017/0360102 | A1 | 12/2017 | Li et al. | |
| 2018/0352855 | A1* | 12/2018 | Prestia | A24C 5/40 |
| 2019/0208813 | A1* | 7/2019 | Rojo-Calderon | A24D 1/20 |
| 2019/0230988 | A1* | 8/2019 | Aoun | A24F 40/465 |

FOREIGN PATENT DOCUMENTS

| | | | |
|---|---|---|---|
| CN | 105934168 | A | 9/2016 |
| CN | 106455711 | A | 2/2017 |
| CN | 106455715 | A | 2/2017 |
| CN | 107920597 | A | 4/2018 |
| GB | 2554141 | A | 3/2018 |
| JP | 201770297 | A | 4/2017 |
| TW | 201609005 | A | 3/2016 |
| TW | 201720318 | A | 6/2017 |
| WO | 2015177294 | A1 | 11/2015 |
| WO | 2016184977 | A1 | 11/2016 |
| WO | 2017029270 | A1 | 2/2017 |
| WO | 2017036954 | A1 | 3/2017 |
| WO | 2018002084 | A1 | 1/2018 |
| WO | 2019030277 | A1 | 2/2019 |

OTHER PUBLICATIONS

International Search Report for Application No. PCT/EP2020/054177, dated May 29, 2020, 3 pages.

Search Report dated Aug. 21, 2022 from Office Action for Taiwanese Application No. 108117046 issued Aug. 25, 2022, 1 Page.

Search Report dated Nov. 28, 2023 from the Office Action for Chinese Application No. 201980032830.3, Issued Dec. 1, 2023, pp. 1-3.

* cited by examiner

AEROSOL GENERATING ARTICLE, A METHOD FOR MANUFACTURING AN AEROSOL GENERATING ARTICLE AND AN AEROSOL GENERATING SYSTEM

CROSS-REFERENCE TO RELATED APPLICATIONS

The present application is a national phase entry under 35 U.S.C. § 371 of International Application No. PCT/EP2019/062496, filed May 15, 2019, published in English, which claims priority to European Application No. 18173398.1 filed May 21, 2018, European Application No. 18173404.7 filed May 21, 2018, European Application No. 18173406.2 filed May 21, 2018, European Application No. 18176708.8 filed Jun. 8, 2018, International Application No. PCT/EP2018/065155 filed Jun. 8, 2018, and European Application No. 18209147.0 filed Nov. 29, 2018, the disclosures of which are incorporated herein by reference.

TECHNICAL FIELD

The present disclosure relates generally to an aerosol generating article, and more particularly to an aerosol generating article for use with an aerosol generating device for heating the aerosol generating article to generate an aerosol for inhalation by a user. Embodiments of the present disclosure also relate to a method for manufacturing an aerosol generating article and to an aerosol generating system.

TECHNICAL BACKGROUND

Devices which heat, rather than burn, an aerosol generating material to produce an aerosol for inhalation have become popular with consumers in recent years.

Such devices can use one of a number of different approaches to provide heat to the aerosol generating material. One such approach is to provide an aerosol generating device which employs an induction heating system and into which an aerosol generating article, comprising aerosol generating material, can be removably inserted by a user. In such a device, an induction coil is provided with the device and an induction heatable susceptor is provided with the aerosol generating article. Electrical energy is provided to the induction coil when a user activates the device which in turn generates an alternating electromagnetic field. The susceptor couples with the electromagnetic field and generates heat which is transferred, for example by conduction, to the aerosol generating material and an aerosol is generated as the aerosol generating material is heated.

The characteristics of the aerosol generated by the aerosol generating device are dependent upon a number of factors, including the construction of the aerosol generating article used with the aerosol generating device. There is, therefore, a desire to provide an aerosol generating article which is easy to manufacture and which enables the characteristics of the aerosol generated during use of the article to be optimised.

SUMMARY OF THE DISCLOSURE

According to a first aspect of the present disclosure, there is provided an aerosol generating article comprising:

aerosol generating material having first and second regions; and an inductively heatable susceptor in the first region.

According to a second aspect of the present disclosure, there is provided a method for manufacturing an aerosol generating article comprising aerosol generating material having first and second regions, the method comprising positioning an inductively heatable susceptor in the first region.

The aerosol generating article is for use with an aerosol generating device for heating the aerosol generating material, without burning the aerosol generating material, to volatise at least one component of the aerosol generating material and thereby generate a vapour or aerosol for inhalation by a user of the aerosol generating device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The aerosol generating article is easy to manufacture because the inductively heatable susceptor can be inserted easily into the first region.

The aerosol generating material may have a first end and a second end and may have an intermediate point between the first and second ends.

In one embodiment, the first region may be located upstream of the second region relative to an aerosol flow direction within the article. By providing an inductively heatable susceptor exclusively in the upstream first region, the aerosol generating material in the first region is heated by the heat generated by the inductively heatable susceptor to generate an aerosol. The aerosol then flows through the aerosol generating material in the second region, downstream of the first region, which helps it to cool and condense to form a vapour or aerosol suitable for inhalation by a user of the aerosol generating device. As the aerosol flows through the second region, the flavour characteristics of the aerosol are also enhanced by the aerosol generating material in the second region, thereby ensuring that the characteristics of the aerosol or vapour generated during use of the article are optimised.

The first region may extend from the first end to the intermediate point and the second region may extend from the intermediate point to the second end. The inductively heatable susceptor may include an elongate part which extends from the first end to the intermediate point. With this arrangement, the inductively heatable susceptor extends fully through the first region ensuring that the aerosol generating material in the first region is heated in the most effective manner by heat transferred from the inductively heatable susceptor.

In another embodiment, the first region may be located downstream of the second region relative to an aerosol flow direction within the article. By providing an inductively heatable susceptor exclusively in the downstream first region, the aerosol generating material in the first region is heated by the heat generated by the inductively heatable susceptor to generate an aerosol. As air flows through the upstream second region, flavour compounds may be released from the aerosol generating material in the second region and entrained in the air before the air flows through the downstream first region, thereby enhancing the characteristics of the aerosol or vapour generated during use of the article. The aerosol generating article also has an improved appearance because the inductively heatable susceptor is not positioned in the upstream second region and, therefore, is not visible from the first end. Positioning the inductively heatable susceptor in the downstream first region also ensures that the inductively heatable susceptor cannot be released from the aerosol generating material, for example by dropping out of the first end.

The first region may extend from the second end to the intermediate point and the second region may extend from the intermediate point to the first end. The inductively heatable susceptor may include an elongate part which extends from the second end to the intermediate point. With this arrangement, the inductively heatable susceptor extends fully through the first region ensuring that the aerosol generating material in the first region is heated in the most effective manner by heat transferred from the inductively heatable susceptor.

The inductively heatable susceptor may extend in a direction substantially parallel to a longitudinal direction of the aerosol generating article. With this arrangement, air flow resistance through the aerosol generating article is minimised.

The inductively heatable susceptor may be tubular. The use of a tubular susceptor ensures that heat is generated effectively in the first region because the tubular shape of the susceptor provides a closed circular electrical path which is suitable for generating eddy currents.

The wall thickness of tubular inductively heatable susceptor may be between 50 μm and 500 μm, may typically be between 75 μm and 300 μm and may more typically be between 100 μm and 200 μm. In one example, the wall thickness may be approximately 150 μm. A wall thickness within these ranges facilitates insertion of the tubular inductively heatable susceptor into the first region of the aerosol generating material. For example, if the wall thickness is too low, the tubular inductively heatable susceptor may be deformed during insertion into the aerosol generating material. If, on the other hand, the wall thickness is too great, insertion of the tubular inductively heatable susceptor may be difficult and the aerosol generating material may be deformed or displaced. In addition, a wall thickness within these ranges ensures that that the tubular inductively heatable susceptor is heated quickly during use of the aerosol generating article in an aerosol generating device.

The tubular inductively heatable susceptor may be continuous in the circumferential direction and may not have a longitudinally extending joint or seam. The tubular inductively heatable susceptor thus has a uniform electrical resistance.

The aerosol generating material in the first region may be positioned both inside and outside of the tubular inductively heatable susceptor. With this arrangement, heat from the tubular inductively heatable susceptor is transferred to the aerosol generating material positioned both inside and outside of the tubular susceptor, thereby optimising aerosol generation and improving energy efficiency as the susceptor is surrounded by the aerosol generating material.

The inductively heatable susceptor may include a sharpened or pointed end and may possibly include a plurality of sharpened or pointed ends. The or each sharpened or pointed end may be positioned at the intermediate point of the aerosol generating material. The provision of an inductively heatable susceptor with a sharpened or pointed end allows the inductively heatable susceptor to be easily positioned in the aerosol generating material, for example by being inserted into the aerosol generating material from the first end or the second end, during manufacture of the aerosol generating article.

In some embodiments, the sharpened or pointed end may have a surface area of less than 1 $mm^2$. The surface area could be less than 0.5 $mm^2$ and is typically less than 0.25 $mm^2$. A small surface area facilitates insertion of the inductively heatable susceptor into the aerosol generating material during manufacture of the aerosol generating article.

The inductively heatable susceptor may comprise a flat part. The flat part may be positioned at the first end of the aerosol generating material in embodiments in which the first region is upstream of the second region. The flat part may be positioned at the second end of the aerosol generating material in embodiments in which the first region is downstream of the second region. The flat part may have a projected or an encompassed area of greater than 1 $mm^2$, preferably greater than 2 $mm^2$, and less than a cross-sectional area of the aerosol generating article. In some embodiments, the projected or encompassed area of the flat part may be greater than the surface area of the flat part. In one example, the inductively heatable susceptor may be tubular and may have an annular flat part. The surface area of the flat part corresponds to the annular area and the projected or encompassed area corresponds to the area bounded by the outer periphery of the tubular susceptor, e.g. circular area, wherein the bounded area is greater than the annular area. It will be understood by one of ordinary skill in the art that other shapes of inductively heatable susceptor can be employed in which the projected or encompassed area of the flat part is greater than the surface area of the flat part. The provision of a flat part may allow the inductively heatable susceptor to be more easily manipulated and inserted into the aerosol generating material from the first end or the second end with the correct orientation such as angle.

By way of non-limiting example, the inductively heatable susceptor may be U-shaped, E-shaped or I-shaped. It will be understood that U-shaped and E-shaped inductively heatable susceptors are examples of inductively heatable susceptors including both a flat part and a plurality of sharpened or pointed ends at an opposite end of the inductively heatable susceptor.

The inductively heatable susceptor may be connected to a sharpened or pointed part comprising a non-inductively heatable material. The non-inductively heatable material may comprise a material which is substantially non-electrically conductive and non-magnetically permeable. With this arrangement, it will be understood that heat is not generated in the sharpened or pointed part. The ease of manufacture of the sharpened or pointed part may be improved due to the use of a non-inductively heatable material, for example a plastics material or a ceramic material which is resistant to high temperatures.

In one embodiment, the inductively heatable susceptor may be connected at one end to a sharpened or pointed part comprising a non-inductively heatable material.

In another embodiment, the sharpened or pointed part may include a connector, such as a tubular connector, and the inductively heatable susceptor may be connected to the connector. The provision of a connector may facilitate connection of the sharpened or pointed part and the inductively heatable susceptor.

In a first example, a tubular inductively heatable susceptor may be positioned around a tubular connector and may form a sleeve which surrounds, and is connected to, the tubular connector. This arrangement may allow the sharpened or pointed end and the inductively heatable susceptor to be connected with relative ease.

In a second example, the inductively heatable susceptor may comprise a coating of inductively heatable material applied to the connector.

The aerosol generating material may comprise an aerosol generating sheet which may be substantially parallel to a longitudinal axis of the aerosol generating article. This arrangement may facilitate insertion of the inductively heatable susceptor into the aerosol generating material from the first end in embodiments in which the first region is upstream of the second region or from the second end in embodiments in which the first region is downstream of the second region and/or may facilitate air flow through the aerosol generating material during use of the aerosol generating article in an aerosol generating device.

In an embodiment, for example in which the first region is located upstream of the second region, a distance between the intermediate point and the second end may be between 20% and 70% of a distance between the first and second ends. The distance between the intermediate point and the second end may be between 30% and 60% of the distance between the first and second ends. The distance between the intermediate point and the second end may be between 40% and 60% of the distance between the first and second ends. The distance between the intermediate point and the second end may be 50% of the distance between the first and second ends. Thus, the intermediate point may be located at a midpoint between the first and second ends. This arrangement provides a good balance between the function of the aerosol generating material in the first and second regions and ensures that the characteristics of the resulting aerosol generated during use of the aerosol generating article are optimised.

An end of the inductively heatable susceptor, for example the flat part, may be flush with the first end of the aerosol generating material in embodiments in which the first region is upstream of the second region. An end of the inductively heatable susceptor, for example the flat part, may be flush with the second end of the aerosol generating material in embodiments in which the first region is downstream of the second region. An end of the inductively heatable susceptor, for example the flat part, may alternatively be embedded in the first end or the second end of the aerosol generating material. Embedding the end of the inductively heatable susceptor in the aerosol generating material may allow an aerosol or vapour to be generated more effectively because the whole of the inductively heatable susceptor is surrounded by aerosol generating material and, therefore, heat transfer from the inductively heatable susceptor to the aerosol generating material is maximised.

The inductively heatable susceptor may have a length which may be greater than a width of the aerosol generating article. The resulting aerosol generating article may have a shape that is optimised for insertion into a cavity of an aerosol generating device.

The aerosol generating material may be wrapped by a sheet of material. The sheet of material thus acts as a wrapper. The wrapper may comprise a material which is substantially non-electrically conductive and non-magnetically permeable and may, for example, comprise a paper wrapper. The use of a wrapper may facilitate manufacture and handing of the aerosol generating article and may enhance aerosol generation.

The aerosol generating article may include an air-permeable member at the first end of the aerosol generating material. The aerosol generating article may include an air-permeable member at the second end of the aerosol generating material. The air-permeable member may be an air-permeable cap. The air-permeable member may be a filter, for example comprising cellulose acetate fibres.

In embodiments in which the first region is positioned upstream of the second region, the aerosol generating article may include an air-permeable member, for example an air-permeable cap, at the first end of the aerosol generating material. The aerosol generating material visible at the first end may be subjected to a small amount of deformation due to insertion of the inductively heatable susceptor into the first region, and the air-permeable member may help to improve the appearance of the aerosol generating article by covering the first end and ensuring that the aerosol generating material in the first region is not exposed or visible. The air-permeable member may also help to ensure that the inductively heatable susceptor is not released from the first region of the aerosol generating material by dropping out of the first end.

The air-permeable member may include an aperture, for example a slit or a hole, for receiving a temperature sensor. The aperture allows a temperature sensor of an aerosol generating device to be positioned in, and possibly to extend through, the air-permeable member and to be positioned in close proximity to the inductively heatable susceptor. This in turn ensures that the temperature of the inductively heatable susceptor can be accurately detected by the temperature sensor and that the control of the aerosol generating device can be optimised.

The aperture may have dimensions which are the same as, or less than, the dimensions of the temperature sensor. For example, in embodiments in which the aperture is a hole, the hole may have an inner diameter which is the same as, or less than, an outer diameter of the temperature sensor. With this arrangement, the temperature sensor may advantageously be cleaned during insertion of the temperature sensor into the aperture (as the aerosol generating article is inserted into an aerosol generating device) and/or during removal of the temperature sensor from the aperture (as the aerosol generating article is removed from an aerosol generating device).

In embodiments in which the first region is positioned upstream of the second region, the air-permeable member may be in abutting co-axial alignment with the first region of the aerosol generating material.

In embodiments in which the first region is positioned upstream of the second region, the air-permeable member may be in co-axial alignment with, and spaced from, the first region of the aerosol generating material. The air-permeable member may be spaced from the first region of the aerosol generating material by a gap, for example created by a hollow tubular member which may be positioned between the first end and the air-permeable member. The spacing between the air-permeable member and the first region of the aerosol generating material provided by the gap increases the distance between the air-permeable member and the inductively heatable susceptor positioned in the first region. This in turn reduces the likelihood of damage to the air-permeable member due to heat transfer from the inductively heatable susceptor. The spacing provided by the gap may also help to trap any condensed vapour or aerosol emitted from the first end during heating of the aerosol generating material in the first region, thereby minimising or eliminating the release of the condensed vapour or aerosol from the first end.

The aperture in the air-permeable member and/or the length of the air-permeable member may be dimensioned so that a temperature sensor of an aerosol generating device extends through the air-permeable member and into the gap, for example into the hollow tubular member, between the air-permeable member and the first region of the aerosol generating material. With this arrangement, the temperature sensor can be positioned in close proximity to the inductively heatable susceptor, thereby ensuring that the temperature of the inductively heatable susceptor can be accurately detected by the temperature sensor and that the control of the aerosol generating device can be optimised. In addition, the temperature sensor can be cleaned more effectively by the air-permeable member during insertion of the temperature sensor into the aperture (as the aerosol generating article is inserted into an aerosol generating device) and/or during removal of the temperature sensor from the aperture (as the aerosol generating article is removed from an aerosol generating device).

In one embodiment of the method according to the second aspect, the first region may be located upstream of the second region, the first region may extend from a first end of the aerosol generating material to an intermediate point between the first end and a second end of the aerosol generating material, the second region may extend from the intermediate point to the second end, and the inductively heatable susceptor may be tubular. In this case, the method may comprise inserting the tubular inductively heatable susceptor into the first region from the first end so that it extends from the first end to the intermediate point.

In another embodiment of the method according to the second aspect, the first region may be located downstream of the second region, the first region may extend from a second end of the aerosol generating material to an intermediate point between the second end and a first end of the aerosol generating material, the second region may extend from the intermediate point to the first end, and the inductively heatable susceptor may be tubular. In this case, the method may comprise inserting the tubular inductively heatable susceptor into the first region from the second end so that it extends from the second end to the intermediate point.

The method may comprise inserting the tubular inductively heatable susceptor into the first region so that the aerosol generating material is positioned both inside and outside of the tubular inductively heatable susceptor. As explained above, this arrangement ensures that heat from the tubular inductively heatable susceptor is transferred to the aerosol generating material positioned both inside and outside of the tubular inductively heatable susceptor, thereby optimising aerosol generation and maximising energy efficiency.

The method may comprise inserting the tubular inductively heatable susceptor into the first region by a pusher. The pusher may have a tapered part, for example a tapered end, which can be partially inserted into an end of the tubular inductively heatable susceptor. The tapered part may have an external diameter which corresponds to an internal diameter of the tubular inductively heatable susceptor. Correct insertion of the tubular inductively heatable susceptor into the first region is thereby assured by the pusher.

The method may comprise inserting the inductively heatable susceptor into the first region from the first end or the second end so that it extends to the intermediate point and may comprise supporting the aerosol generating material at the opposite one of the first and second ends during insertion of the inductively heatable susceptor into the first region. In embodiments in which the first region is located upstream of the second region, the method may comprise inserting the inductively heatable susceptor into the first region from the first end so that it extends from the first end to the intermediate point and supporting the aerosol generating material at the second end during insertion of the inductively heatable susceptor into the first region. In embodiments in which the first region is located downstream of the second region, the method may comprise inserting the inductively heatable susceptor into the first region from the second end so that it extends from the second end to the intermediate point and supporting the aerosol generating material at the first end during insertion of the inductively heatable susceptor into the first region.

The aerosol generating material may be supported at the first end or the second end by a support member. Supporting the aerosol generating material during insertion of the inductively heatable susceptor, for example by the support member, may ensure that the aerosol generating material is adequately supported and not displaced by the inductively heatable susceptor as it is inserted into the aerosol generating material.

The support member may be an external support member, for example part of a manufacturing apparatus. The method may comprise supporting the aerosol generating material at the first end or the second end by the external support member and may comprise inserting the inductively heatable susceptor into the first region from the first end or the second end prior to assembling the aerosol generating material with other component parts of the aerosol generating article. With this arrangement, the first end or the second end of the aerosol generating material is supported directly by the external support member. This allows other component parts of the aerosol generating article, such as a filter, to be combined with the aerosol generating material after insertion of the inductively heatable susceptor into the first region, thereby allowing greater freedom in the design and construction of the aerosol generating article.

The support member may be an integral support member provided by a component part of the aerosol generating article, for example a filter. The method may comprise inserting the inductively heatable susceptor into the first region from the first end or the second end after assembling the aerosol generating material and the component part intended as the integral support member. With this arrangement, the aerosol generating material is supported at the first end or the second end by the integral support member during insertion of the inductively heatable susceptor into the first region from the opposite one of the first end or the second end. The manufacturing apparatus and method can be simplified because the need for an external support member is avoided.

The aerosol generating material in the second region, i.e. between the intermediate point and the other of the first and second ends from which the inductively heatable susceptor is not inserted, may be compressed in a direction perpendicular to an axis of the aerosol generating material or a direction of the insertion during insertion of the inductively heatable susceptor into the first region. The act of compressing the aerosol generating material in the second region during insertion of the inductively heatable susceptor into the first region ensures that the aerosol generating material is adequately supported and not displaced during insertion of the inductively heatable susceptor.

The method may comprise positioning the aerosol generating material in a receiving portion formed around an outer surface of a drum. The receiving portion may have a first receiving section that does not compress the aerosol generating material in the first region and may have a second receiving section that compresses the aerosol generating material in the second region. The method may comprise supporting the aerosol generating material in the receiving portion by a support drum. The use of a drum having first (non-compression) and second (compression) receiving sections, in combination with an optional support drum, provides a convenient way to compress the aerosol generating material in the second region.

The method may comprise wrapping a sheet of material around the aerosol generating material.

In embodiments in which the first region is located downstream of the second region, the method may comprise positioning a filter at the second end in coaxial alignment with the aerosol generating material and after insertion of the inductively heatable susceptor into the first region of the aerosol generating material from the second end. The method may further comprise positioning a hollow tubular member between the second end and the filter. The hollow tubular member may advantageously allow the heated vapour or aerosol from the first region to cool and condense before it is inhaled by a user through the filter during use of the aerosol generating article in an aerosol generating device.

The method may further comprise wrapping a sheet of material around the aerosol generating material, the filter and the optional hollow tubular member. This ensures that the component parts of the aerosol generating article are retained in the correct positional relationship.

According to a third aspect of the present disclosure, there is provided an aerosol generating system comprising:

an aerosol generating device comprising an induction coil defining a cavity, the induction coil being configured to generate an alternating electromagnetic field; and an aerosol generating article as defined above positioned in the cavity so that a longitudinal axis of the inductively heatable susceptor is substantially aligned with a longitudinal axis of the cavity.

By positioning the aerosol generating article in the cavity so that the longitudinal axis of the inductively heatable susceptor, e.g. the tubular inductively heatable susceptor, is substantially aligned with the longitudinal axis of the cavity, the positional relationship between the inductively heatable susceptor and the induction coil is optimised thereby providing for optimum coupling of the electromagnetic field with the inductively heatable susceptor and, thus, optimum heating of the inductively heatable susceptor during operation of the aerosol generating device.

The inductively heatable susceptor may comprise one or more, but not limited, of aluminium, iron, nickel, stainless steel and alloys thereof, e.g. Nickel Chromium or Nickel Copper. With the application of an electromagnetic field in its vicinity, the susceptor may generate heat due to eddy currents and magnetic hysteresis losses resulting in a conversion of energy from electromagnetic to heat.

The induction coil may comprise a Litz wire or a Litz cable. It will, however, be understood that other materials could be used. The induction coil may be substantially helical in shape and may, for example, extend around the cavity in which the aerosol generating article is positioned.

The circular cross-section of a helical induction coil may facilitate the insertion of the aerosol generating article into the aerosol generating device, for example into the cavity in which the aerosol generating article is received in use, and may ensure uniform heating of the aerosol generating material.

The induction coil may be arranged to operate in use with a fluctuating electromagnetic field having a magnetic flux density of between approximately 20 mT and approximately 2.0 T at the point of highest concentration.

The aerosol generating device may include a power source and circuitry which may be configured to operate at a high frequency. The power source and circuitry may be configured to operate at a frequency of between approximately 80 kHz and 500 kHz, possibly between approximately 150 kHz and 250 kHz, and possibly at approximately 200 kHz. The power source and circuitry could be configured to operate at a higher frequency, for example in the MHz range, depending on the type of inductively heatable susceptor that is used.

The aerosol generating material may be any type of solid or semi-solid material. Example types of aerosol generating material include powder, granules, particles, gel, strips, loose leaves, cut filler, pellets, powder, shreds, strands, foam material and sheets. The aerosol generating material may comprise plant derived material and in particular, may comprise tobacco.

The aerosol generating material may comprise an aerosol-former. Examples of aerosol-formers include polyhydric alcohols and mixtures thereof such as glycerine or propylene glycol. Typically, the aerosol generating material may comprise an aerosol-former content of between approximately 5% and approximately 50% on a dry weight basis. In some embodiments, the aerosol generating material may comprise an aerosol-former content of approximately 15% on a dry weight basis.

DETAILED DESCRIPTION OF EMBODIMENTS

Embodiments of the present disclosure will now be described by way of example only and with reference to the accompanying drawings.

Figure 1B:
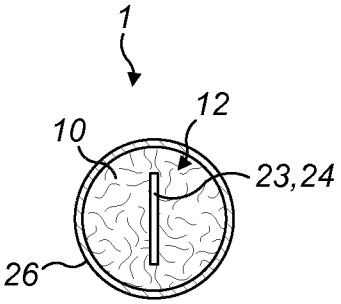
FIG. 1*b* is a diagrammatic view in the direction of Arrow A shown in FIG. 1*a;*
Figure 1A:
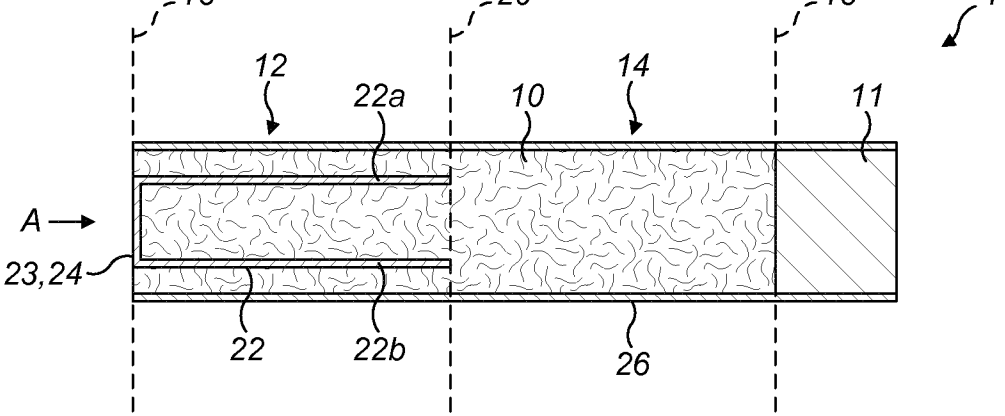
FIG. 1*a* is a diagrammatic cross-sectional view of a first example of an aerosol generating article.

Referring initially to FIGS. 1*a* and 1*b*, there is shown a first example of an aerosol generating article 1 for use with an aerosol generating device, an example of which will be described later in this specification. The aerosol generating article 1 is elongate and substantially cylindrical. The circular cross-section facilitates handling of the article 1 by a user and insertion of the article 1 into a cavity of an aerosol generating device.

The article 1 comprises aerosol generating material 10 having a first region 12 and a second region 14. The first region 12 is located upstream of the second region 14 relative to an aerosol flow direction within the article 1. The aerosol generating material 10 has a first end 16, a second end 18 and an intermediate point 20 between the first and second ends 16, 18. In the illustrated embodiment, the intermediate point 20 is located at a midpoint between the first and second ends 16, 18, so that the first and second regions 12, 14 have the same longitudinal dimension. The intermediate point 20 could, however, be located at other positions between the first and second ends 16, 18 as explained earlier in this specification.

The article 1 comprises a filter 11, for example comprising cellulose acetate fibres, located downstream of the second region 14 and through which a user can inhale an aerosol or vapour generated during use of the article 1 in an aerosol generating device. The aerosol generating material 10 and the filter 11 are wrapped by a sheet of material, for example a paper wrapper 26, to maintain the positional relationship between the first and second regions 12, 14 of the aerosol generating material 10 and the filter 11.

The article 1 comprises an inductively heatable susceptor 22 which is positioned in the first region 12. The inductively heatable susceptor 22 is substantially U-shaped, comprising two elongate parts 22*a*, 22*b*, which extend through the first region 12 from the first end 16 to the intermediate point 20, and a connecting part 23 which connects the two elongate parts 22*a*, 22*b*.

The ends of the elongate parts 22*a*, 22*b* can be sharpened or pointed to facilitate insertion of the inductively heatable susceptor 22 into the first region 12 from the first end 16. The connecting part 23 constitutes a flat part 24 which allows the inductively heatable susceptor 22 to be easily manipulated and inserted into the first region 12 from the first end 16, for example in the correct orientation. In the illustrated example, the end of the inductively heatable susceptor 22, constituted by the flat part 24, is flush with the first end 16 of the aerosol generating material 10 but it will be appreciated that in other embodiments the end of the inductively heatable susceptor 22 constituted by the flat part 24 could be embedded in the first end 16 so that the inductively heatable susceptor 22 is fully surrounded by the aerosol generating material 10 in the first region 12.

The aerosol generating material 10 is typically a solid or semi-solid material. Examples of suitable aerosol forming solids include powder, granules, particles, gel, strips, loose leaves, cut filler, pellets, powder, shreds, strands, foam material and sheets. The aerosol generating material 10 typically comprises plant derived material and, in particular, comprises tobacco.

The aerosol generating material 10 comprises an aerosol-former such as glycerine or propylene glycol. Typically, the aerosol generating material may comprise an aerosol-former content of between approximately 5% and approximately 50% on a dry weight basis. Upon heating, the aerosol generating material 10 releases volatile compounds possibly including nicotine or flavour compounds such as tobacco flavouring.

When a time varying electromagnetic field is applied in the vicinity of the inductively heatable susceptor 22 during use of the article 1 in an aerosol generating device, heat is generated in the inductively heatable susceptor 22 due to eddy currents and magnetic hysteresis losses and the heat is transferred from the inductively heatable susceptor 22 to the aerosol generating material 10 in the first region 12 to heat the aerosol generating material 10 in the first region 12 without burning it and to thereby generate an aerosol. As a user inhales through the filter 11, the aerosol is drawn in a downstream direction through the article 1 from the first region 12 and through the second region 14. As the aerosol flows through the second region 14 towards the filter 11, the aerosol generating material 10 in the second region 14 causes the aerosol to cool and condense to form an aerosol or vapour with suitable characteristics for inhalation by a user through the filter 11. At the same time, one or more volatile components may also be released from the aerosol generating material 10 in the second region 14 due to heating of the aerosol generating material 10 in the second region 14 by the heated aerosol flowing through the second region 14, thereby enhancing the characteristics (e.g. flavour) of the vapour or aerosol that is delivered to a user through the filter 11.

Figure 2B:
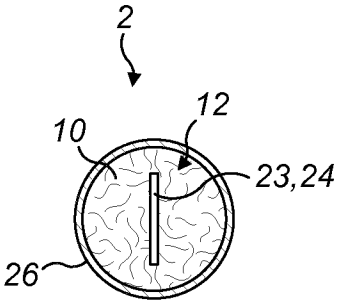
FIG. 2*b* is a diagrammatic view in the direction of Arrow A shown in FIG. 2*a;*
Figure 2A:
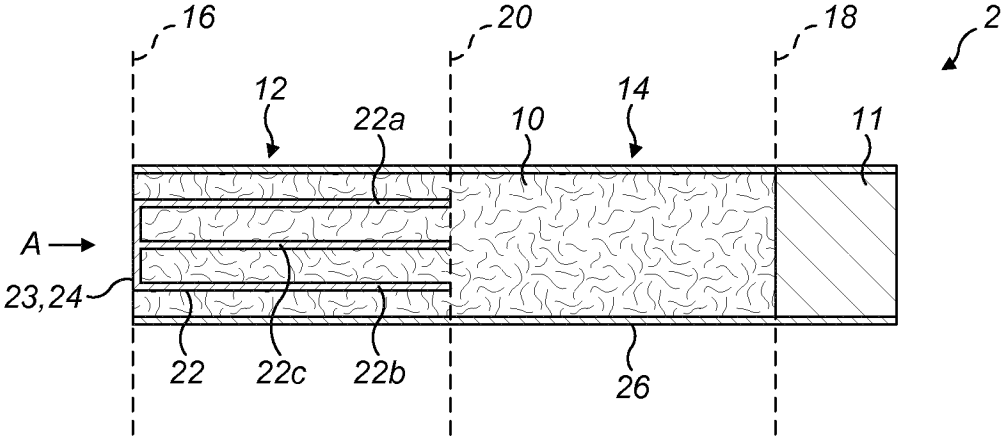
FIG. 2*a* is a diagrammatic cross-sectional view of a second example of an aerosol generating article.

Referring now to FIGS. 2*a* and 2*b*, there is shown a second example of an aerosol generating article 2 which is similar to the aerosol generating article 1 illustrated in FIGS. 1*a* and 1*b* and in which corresponding elements are designated using the same reference numerals.

The aerosol generating article 2 is identical to the aerosol generating article 1 illustrated in FIGS. 1*a* and 1*b* in all respects except that the inductively heatable susceptor 22 is substantially E-shaped, comprising three elongate parts 22*a*, 22*b*, 22*c* which extend through the first region 12 from the first end 16 to the intermediate point 20. The three elongate parts 22*a*, 22*b*, 22*c* are connected by a connecting part 23.

As discussed above, the ends of the elongate parts 22*a*, 22*b*, 22*c* can be sharpened or pointed to facilitate insertion of the inductively heatable susceptor 22 into the first region 12 from the first end 16. The connecting part 23 again constitutes a flat part 24 which allows the inductively heatable susceptor 22 to be easily manipulated and inserted into the first region 12 from the first end 16.

Figure 3B:
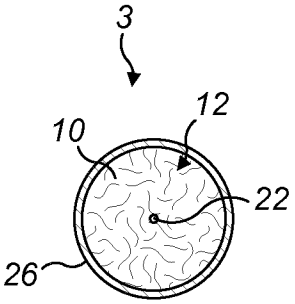
FIG. 3*b* is a diagrammatic view in the direction of Arrow A shown in FIG. 3*a;*
Figure 3A:
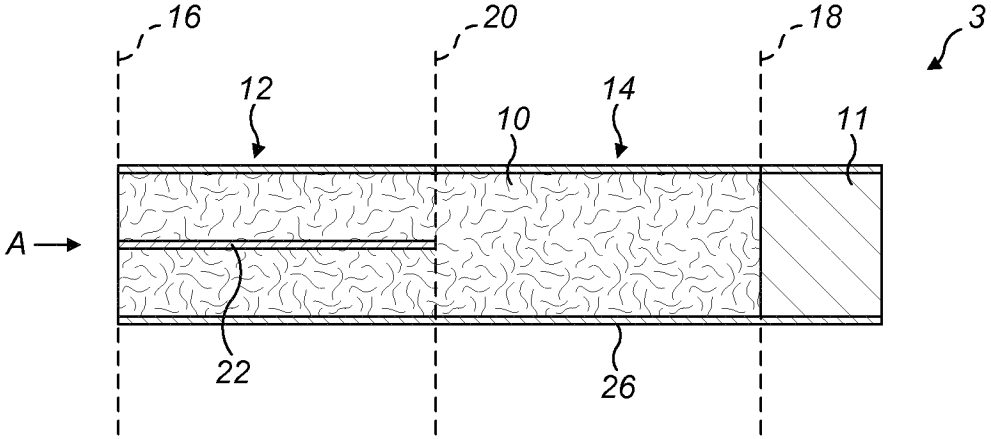
FIG. 3*a* is a diagrammatic cross-sectional view of a third example of an aerosol generating article.

Referring now to FIGS. 3*a* and 3*b*, there is shown a third example of an aerosol generating article 3 which is similar to the aerosol generating article 1 illustrated in FIGS. 1*a* and 1*b* and in which corresponding elements are designated using the same reference numerals.

The aerosol generating article 3 is identical to the aerosol generating article 1 illustrated in FIGS. 1*a* and 1*b* in all respects except that the inductively heatable susceptor 22 is substantially I-shaped, comprising a single elongate part 22 which extends through the first region 12 from the first end 16 to the intermediate point 20. As best seen in FIG. 3*b*, the inductively heatable susceptor 22 is positioned in the first region 12 at the centre of the aerosol generating material 10 to ensure that the aerosol generating material 10 in the first region 12 is uniformly heated.

Figure 4B:
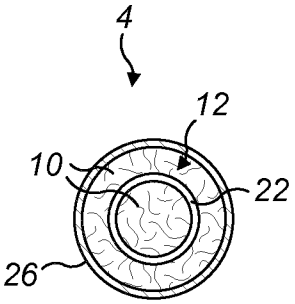
FIG. 4*b* is a diagrammatic view in the direction of Arrow A shown in FIG. 4*a;*
Figure 4A:
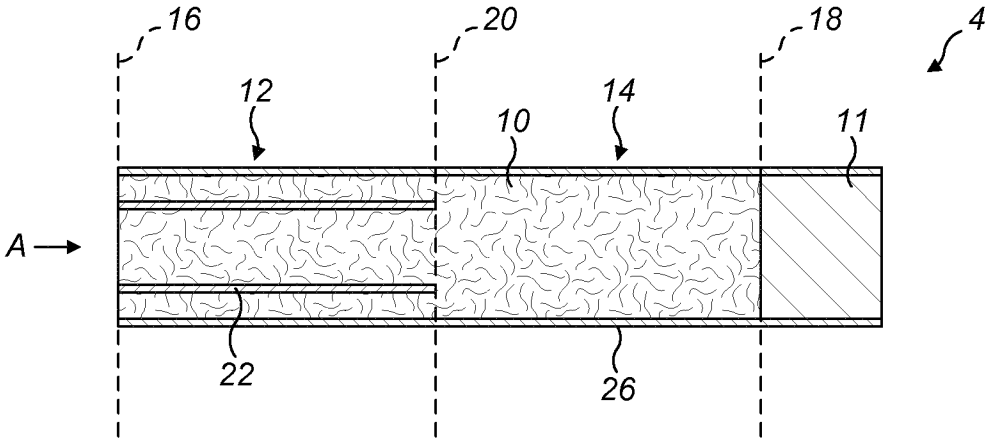
FIG. 4*a* is a diagrammatic cross-sectional view of a fourth example of an aerosol generating article.

Referring now to FIGS. 4*a* and 4*b*, there is shown a fourth example of an aerosol generating article 4 which is similar to the aerosol generating article 1 illustrated in FIGS. 1*a* and 1*b* and in which corresponding elements are designated using the same reference numerals.

The aerosol generating article 4 is identical to the aerosol generating article 1 illustrated in FIGS. 1*a* and 1*b* in all respects except that the inductively heatable susceptor 22 is tubular. The aerosol generating material 10 in the first region 12 is positioned both inside and outside of the tubular inductively heatable susceptor 22 to maximise heat transfer to the aerosol generating material 10 in the first region 12 and to thereby maximise the amount of aerosol that is generated and to maximise energy efficiency.

In preferred embodiments, the tubular induction heatable susceptor 22 and the paper wrapper 26 are concentric, thereby ensuring that the aerosol generating material 10 in the first region 12 is uniformly heated.

Figure 5B:
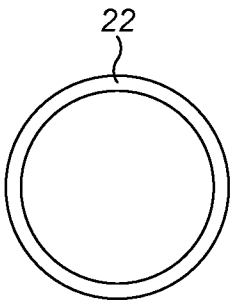
FIGS. 5*a* to 5*c* are diagrammatic views of an end of a tubular inductively heatable susceptor having a sharpened or pointed end.
Figure 5A:
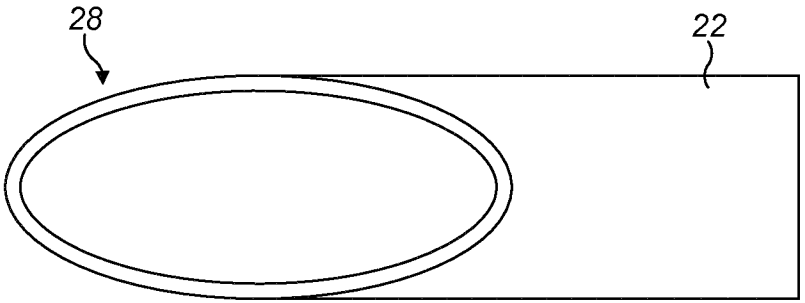
Figure 5C:
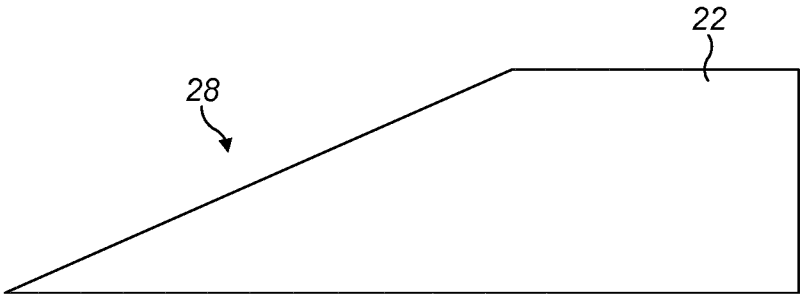

In order to facilitate insertion of the tubular inductively heatable susceptor 22 into the aerosol generating material 10 from the first end 16, the tubular inductively heatable susceptor 22 can comprise a sharpened or pointed end 28, as shown in FIGS. 5*a* to 5*c*, which is positioned at the intermediate point 20 following insertion of the inductively heatable susceptor 22 into the first region 12. By way of example, the sharpened or pointed end 28 can be created by providing a bevel cut at an end of the tubular inductively heatable susceptor 22.

Figure 6B:
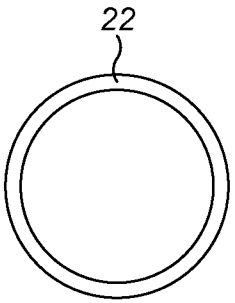
FIGS. 6*a* to 6*c* are diagrammatic views of an end of an inductively heatable susceptor connected at one end to a non-inductively heatable sharpened or pointed part.
Figure 6A:
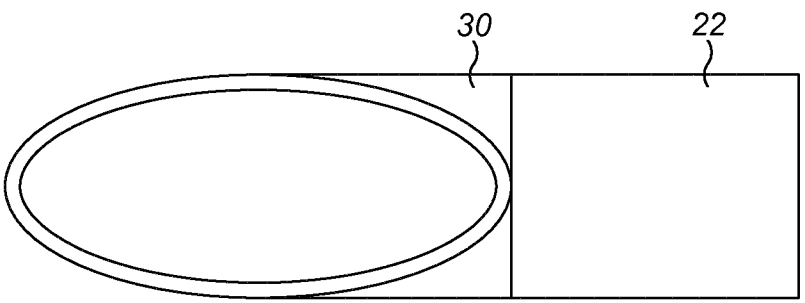
Figure 6C:
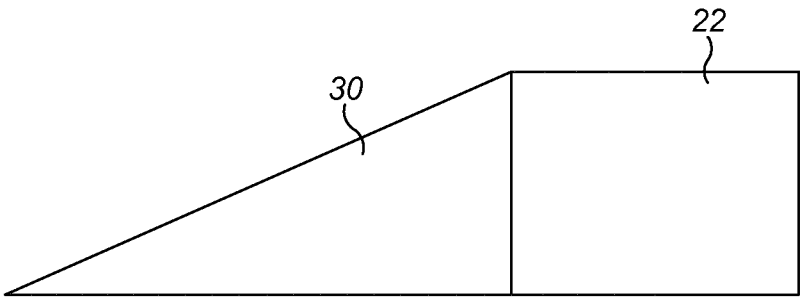

Referring now to FIGS. 6*a* to 6*c*, and in a variation of the example illustrated in FIGS. 5*a* to 5*c*, the tubular inductively heatable susceptor 22 can be connected at one end to a sharpened or pointed part 30 comprising a non-inductively heatable material, for example a plastics material such as polyether ether ketone (PEEK). The ends of the tubular inductively heatable susceptor 22 and the sharpened or pointed part 30 typically have the same outer diameter as illustrated in FIGS. 6*a* and 6*c* and can be connected in any suitable manner. The sharpened or pointed part 30 facilitates insertion of the tubular inductively heatable susceptor 22 into the aerosol generating material 10 from the first end 16 and is positioned at the intermediate point 20 following insertion of the inductively heatable susceptor into the first region 12. The sharpened or pointed part 30 can be easily manufactured, for example by a suitable moulding or extrusion process, potentially avoiding the need to bevel cut the component to provide the sharpened or pointed end.

Figure 7B:
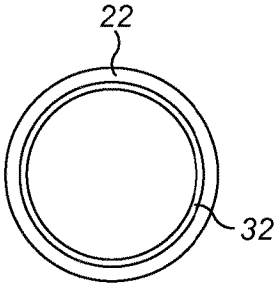
FIGS. 7*a* to 7*e* are diagrammatic views of an end of an inductively heatable susceptor in the form of a sleeve and connected to a non-inductively heatable part.
Figure 7A:
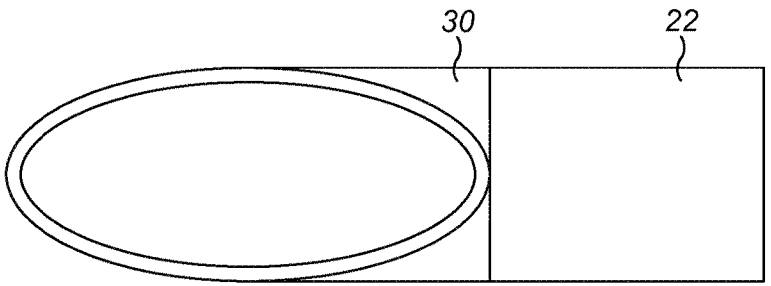
Figure 7C:
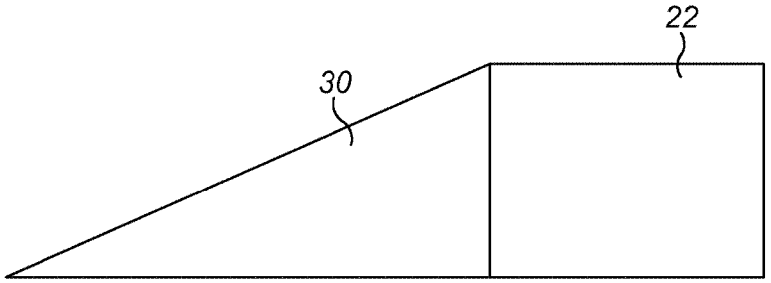
Figure 7D:
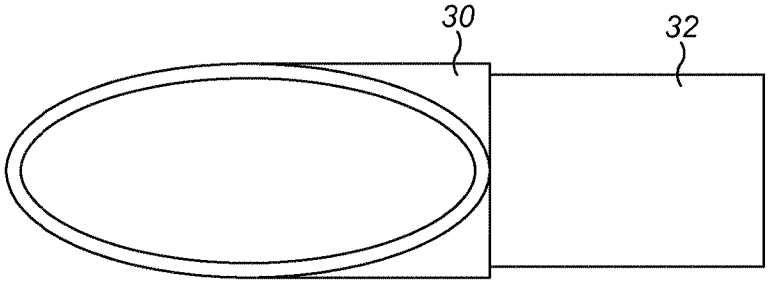
Figure 7E:
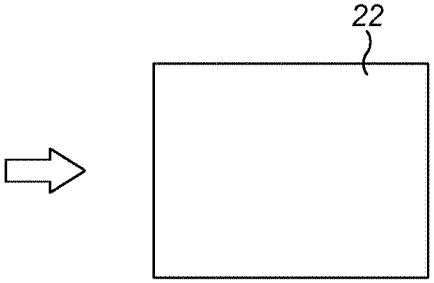

Referring now to FIGS. 7*a* to 7*e*, and in a variation of the example illustrated in FIGS. 6*a* to 6*c*, the tubular inductively heatable susceptor 22 can again be connected to a sharpened or pointed part 30 comprising a non-inductively heatable material, for example a plastics material such as polyether ether ketone (PEEK). In this example, the sharpened or pointed part 30 includes a tubular connector 32 to which the inductively heatable susceptor 22 is connected. The tubular connector 32 has a smaller outer diameter than the inner diameter of the tubular inductively heatable susceptor 22 so that the tubular connector 32 can be inserted into the end of the tubular inductively heatable susceptor 22 as shown in FIGS. 7*d* and 7*e*. Thus, the end of the tubular inductively heatable susceptor 22 forms a sleeve which surrounds, and is connected to, the tubular connector 32. The outer diameter of the sharpened or pointed part 30 where it abuts the end of the tubular inductively heatable susceptor 22 corresponds to the outer diameter of the tubular inductively heatable susceptor 22 to provide a smooth surface which facilitates insertion of the tubular inductively heatable susceptor 22 into the aerosol generating material 10 from the first end 16.

Figure 8:
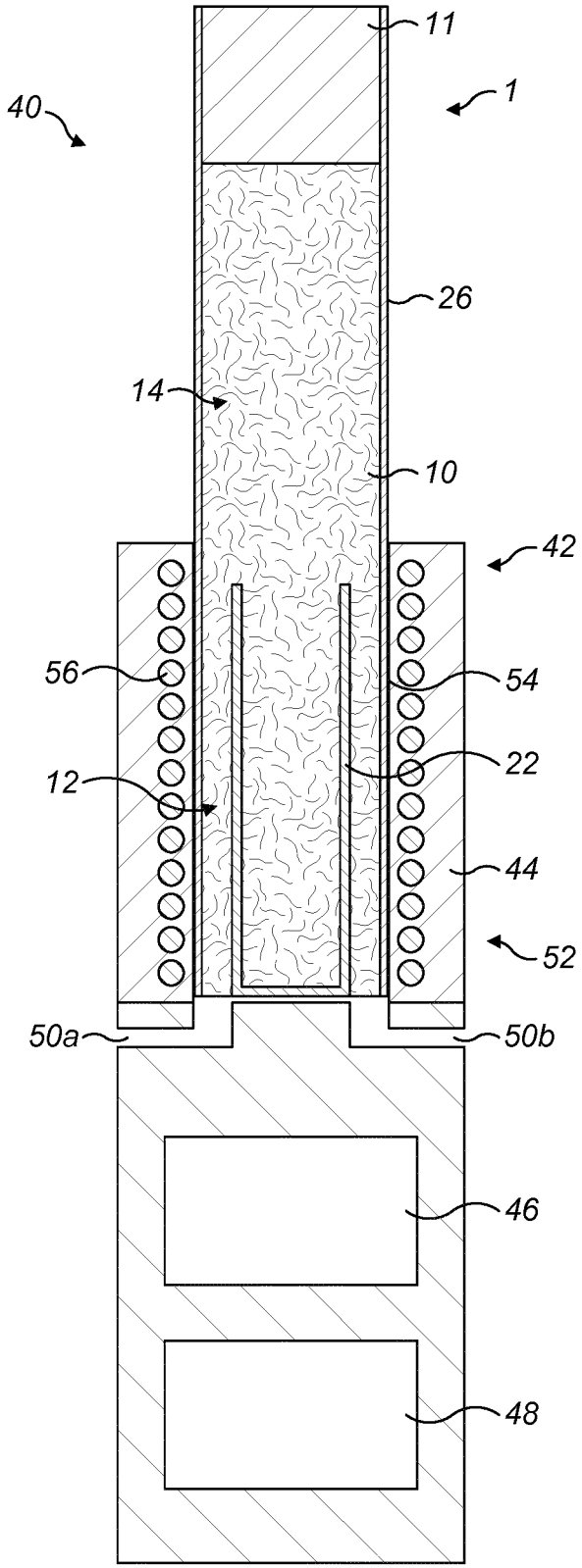
FIG. 8 is a diagrammatic cross-sectional view of an aerosol generating system comprising an aerosol generating device and the first example of the aerosol generating article illustrated in FIGS. 1*a* and 1*b;*

Referring now to FIG. 8, there is shown an aerosol generating system 40 for generating an aerosol to be inhaled. The aerosol generating system 40 comprises an aerosol generating device 42 comprising a housing 44, a power source 46 and control circuitry 48 which may be configured to operate at high frequency. The power source 46 typically comprises one or more batteries which could, for example, be inductively rechargeable. The aerosol generating device 42 also includes one or more air inlets, for example two air inlets 50*a*, 50*b*.

The aerosol generating device 42 comprises an induction heating assembly 52 for heating an aerosol generating material. The induction heating assembly 52 comprises a generally cylindrical cavity 54 which is arranged to receive a correspondingly shaped generally cylindrical aerosol generating article in accordance with aspects of the present disclosure.

FIG. 8 shows the first example of the aerosol generating article 1 illustrated in FIGS. 1*a* and 1*b* positioned in the cavity 54. The cavity 54, which constitutes a heating compartment, and the aerosol generating article 1 are arranged so that the filter 11 projects from the cavity 54 thus enabling a user to engage their lips with filter 11 to inhale a vapour or aerosol generated during operation of the system 40.

The air inlets 50*a*, 50*b* are in communication with the cavity 54 and are arranged to direct air into the first region 12 of the aerosol generating material 10. In a variation (not shown in the drawings), an air-permeable plug can be provided at the lower axial end of the cavity 54 viewed in FIG. 8 so that air through the air inlets 50*a*, 50*b* is uniformly distributed through the aerosol generating material 10 in the first region 12.

The induction heating assembly 52 comprises a helical induction coil 56, having first and second axial ends, which extends around the cylindrical cavity 54 and which can be energised by the power source 46 and control circuitry 48. Thus, the induction coil 56 defines the cavity 54 in which the aerosol generating article 1 is positioned. It will be noted that the cavity 54 and the aerosol generating article 1 each have a respective longitudinal axis and that the longitudinal axes are substantially aligned with each other when the aerosol generating article 1 is positioned inside the cavity 54.

The control circuitry 48 includes, amongst other electronic components, an inverter which is arranged to convert a direct current from the power source 46 into an alternating high-frequency current for the induction coil 56. As will be understood by those skilled in the art, when the induction coil 56 is energised by the alternating high-frequency current, an alternating and time-varying electromagnetic field is produced. This couples with the inductively heatable susceptor 22 and generates eddy currents and/or magnetic hysteresis losses in the inductively heatable susceptor 22 causing it to heat up. The heat is then transferred from the inductively heatable susceptor 22 to the aerosol generating material 10 in the first region 12, for example by conduction, radiation and convection, resulting in the generation of an aerosol. The aerosolisation of the aerosol generating material 10 in the first region 12 is facilitated by the addition of air from the surrounding environment through the air inlets 50*a*, 50*b*. As discussed above, the aerosol generated by heating the aerosol generating material 10 in the first region 12 then flows through the aerosol generating material 10 in the second region 14 where it cools and condenses to form a vapour or aerosol that is suitable for inhalation by a user of the system 40 through the filter 11.

Figure 9:
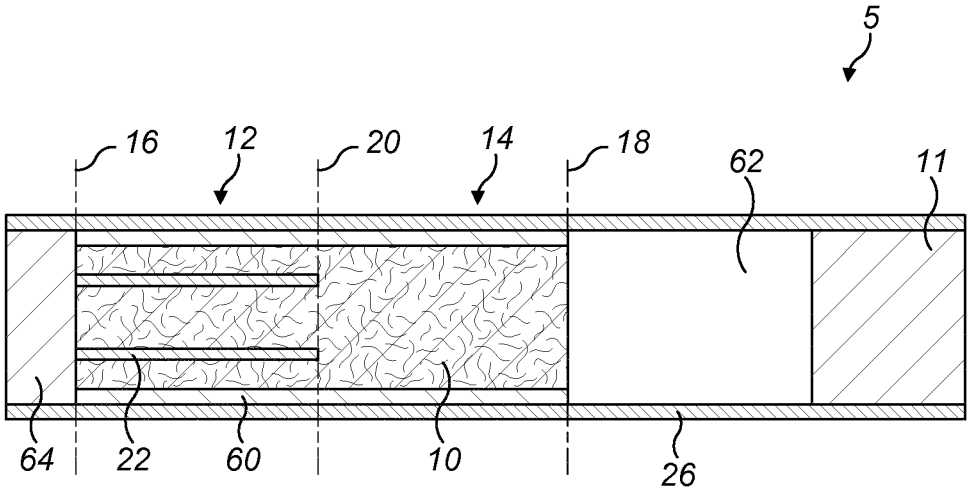
FIG. 9 is a diagrammatic cross-sectional view of a fifth example of an aerosol generating article.

Referring now to FIG. 9, there is shown a fifth example of an aerosol generating article 5 which is similar to the aerosol generating article 4 illustrated in FIGS. 4*a* and 4*b* and in which corresponding elements are designated using the same reference numerals.

The aerosol generating material 10 is advantageously wrapped by a sheet of material, for example a paper wrapper 60, to facilitate handling of the aerosol generating material 10. The tubular inductively heatable susceptor 22 can be positioned in the first region 12 of the aerosol generating material 10 either before or after the aerosol generating material is wrapped by the paper wrapper 60.

The aerosol generating article 5 includes a hollow tubular member 62 positioned between the second end 18 of the aerosol generating material 10 and the filter 11. The aerosol generated during use of the article 5 by heating the aerosol generating material 10 cools and condenses as it flows through the hollow tubular member 62 to form a vapour or aerosol with optimum characteristics for inhalation by a user.

The aerosol generating article 5 includes an air-permeable member 64 in the form of an air-permeable cap at the first end 16 of the aerosol generating material 10 and in abutting co-axial alignment with the first region 12 of the aerosol generating material 10. The air-permeable member 64 is typically a filter, for example comprising cellulose acetate fibres.

The various component parts of the aerosol generating article 5, including the wrapped aerosol generating material 10 with the inductively heatable susceptor 22 positioned therein, the hollow tubular member 62, the filter 11 and the air-permeable member 64, are all wrapped by a sheet of material, for example a paper wrapper 26, to maintain the positional relationship of the component parts of the assembled article 5.

Figure 10:
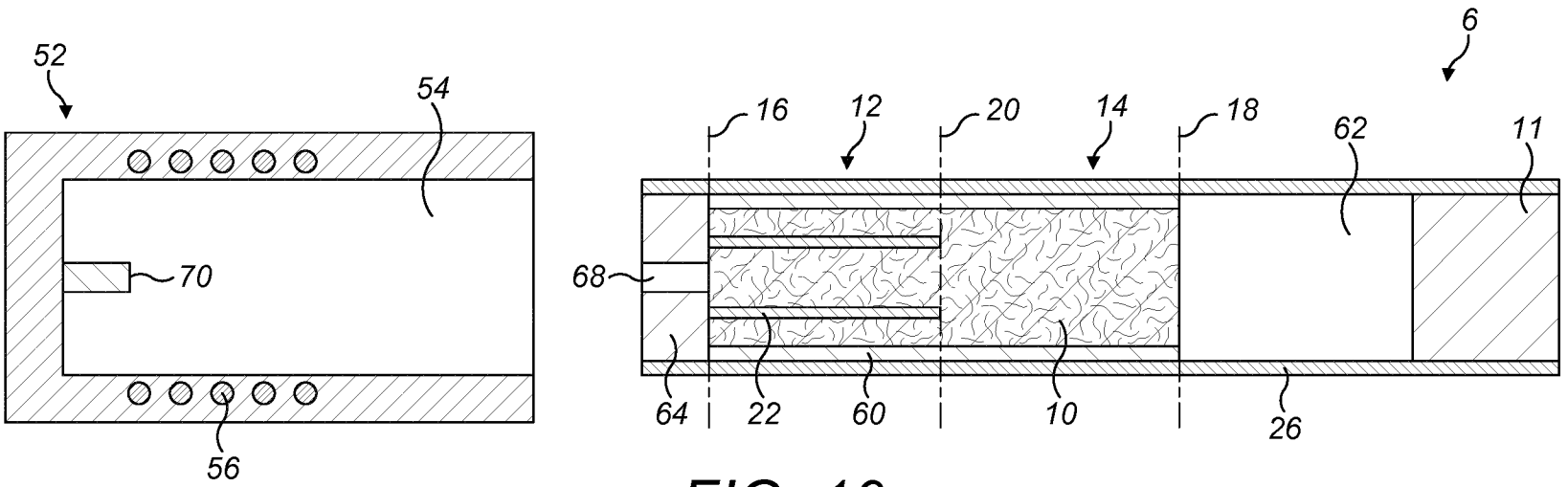
FIGS. 10 and 11 are diagrammatic cross-sectional views of a sixth example of an aerosol generating article and part of an aerosol generating device.
Figure 11:
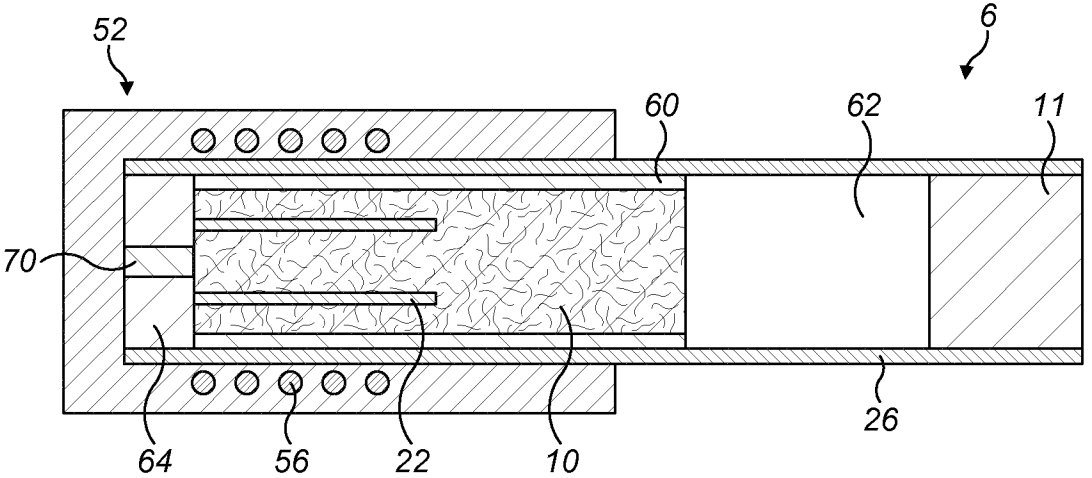

Referring now to FIGS. 10 and 11, there is shown a sixth example of an aerosol generating article 6 which is similar to the aerosol generating article 5 illustrated in FIG. 9 and in which corresponding elements are designated using the same reference numerals.

In the aerosol generating article 6, the air-permeable member 64 includes an aperture 68, for example a slit or a hole, which is adapted to receive a temperature sensor 70 positioned in the cavity 54 of the induction heating assembly 52 described above. As best seen in FIG. 11, the aperture 68 is dimensioned so that the temperature sensor 70 extends fully into the aperture 68 but does not project from it. The aperture 68 is also advantageously dimensioned so that it has an inner diameter which is approximately the same as, or slightly less than, the outer diameter of the temperature sensor 70. In this case, deposits can be removed from the surface of the temperature sensor 70 (thereby cleaning the temperature sensor 70) by the air-permeable member 64 during insertion of the aerosol generating article 6 into the cavity 54 and/or during removal of the aerosol generating article 6 from the cavity 54.

Figure 12:
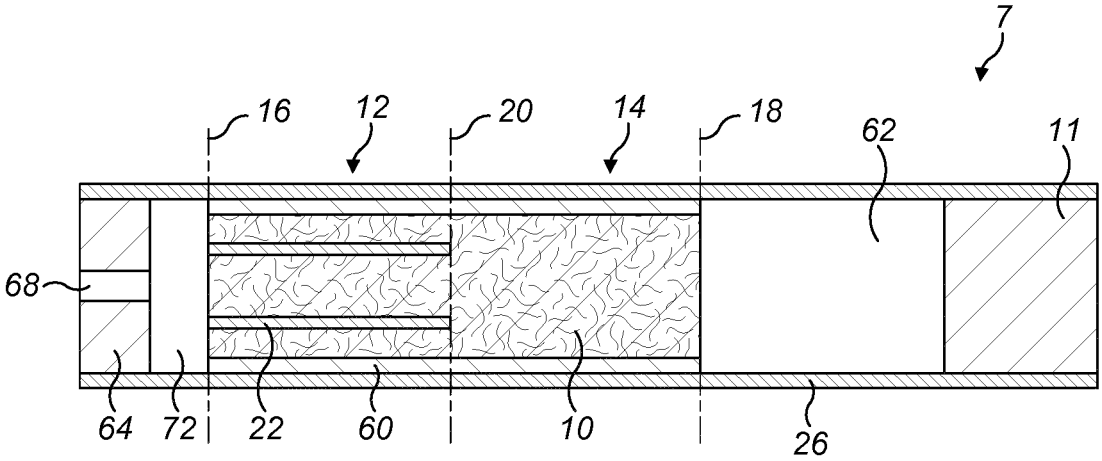
FIGS. 12 and 13 are diagrammatic cross-sectional views of a seventh example of an aerosol generating article and part of an aerosol generating device.
Figure 13:
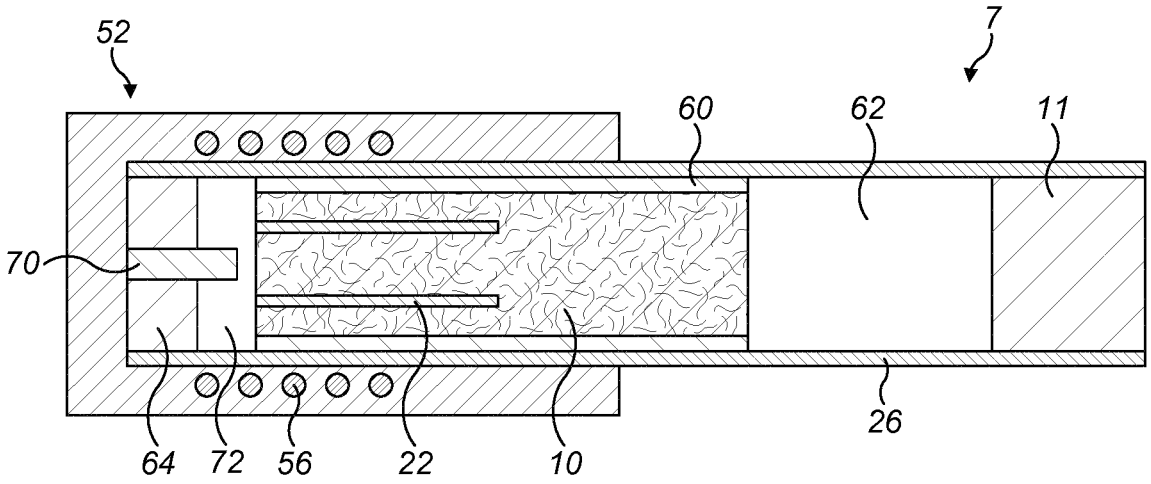

Referring now to FIGS. 12 and 13, there is shown a seventh example of an aerosol generating article 7 which is similar to the aerosol generating article 6 illustrated in FIGS. 10 and 11 and in which corresponding elements are designated using the same reference numerals.

The air-permeable member 64 is in co-axial alignment with the first region 12 of the aerosol generating material 10 but is spaced from the first region 12 by a gap formed by a hollow tubular member 72 that is positioned between the air-permeable member 64 and the first end 16 of the aerosol generating material 10.

As best seen in FIG. 13, the temperature sensor 70 and/or the aperture 68 in the air-permeable member 64 are dimensioned so that the temperature sensor 70 extends through the air-permeable member 64 and projects into the gap formed by the hollow tubular member 72.

Figure 14A:
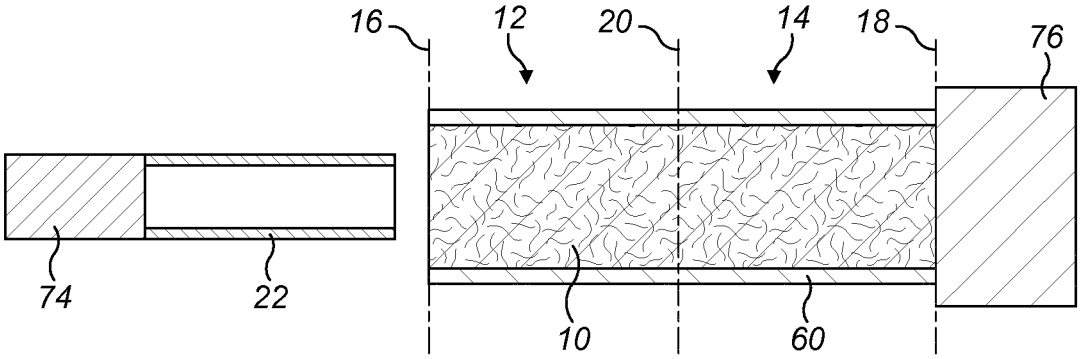
FIGS. 14*a* and 14*b* are diagrammatic illustrations of an apparatus and method for manufacturing the fourth example of the aerosol generating article illustrated in FIGS. 4*a* and 4*b;*
Figure 14B:
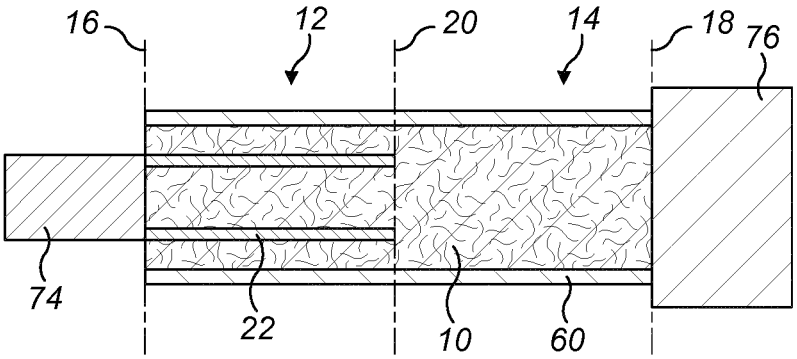

Referring now to FIGS. 14*a* and 14*b*, there is shown an apparatus and method for manufacturing the aerosol generating article 4 described above with reference to FIG. 4.

In order to position the tubular inductively heatable susceptor 22 in the first region 12 of the aerosol generating material 10, a pusher 74 is engaged with an end of the tubular inductively heatable susceptor 22 and moved towards the aerosol generating material 10 to push the tubular inductively heatable susceptor 22 into the first region 12 from the first end 16. The aerosol generating material 10 is also supported at the second end 18 by an external support member 76 which forms part of a manufacturing apparatus (not shown) during insertion of the inductively heatable susceptor 22 into the first region 12.

Figure 15:
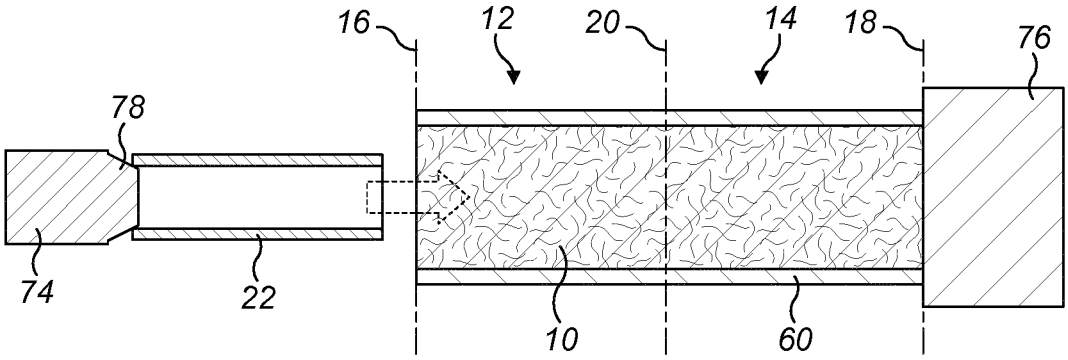
FIG. 15 is a diagrammatic illustration of an apparatus similar to that shown in FIGS. 14*a* and 14*b;*

As shown in FIG. 15, the pusher 74 can advantageously have a tapered end 78 having an external diameter which corresponds to the internal diameter of the tubular inductively heatable susceptor 22, thus allowing the tapered end 78 to be inserted into the end of the tubular inductively heatable susceptor 22 and ensuring optimum alignment and cooperation between these two components.

Figure 16A:
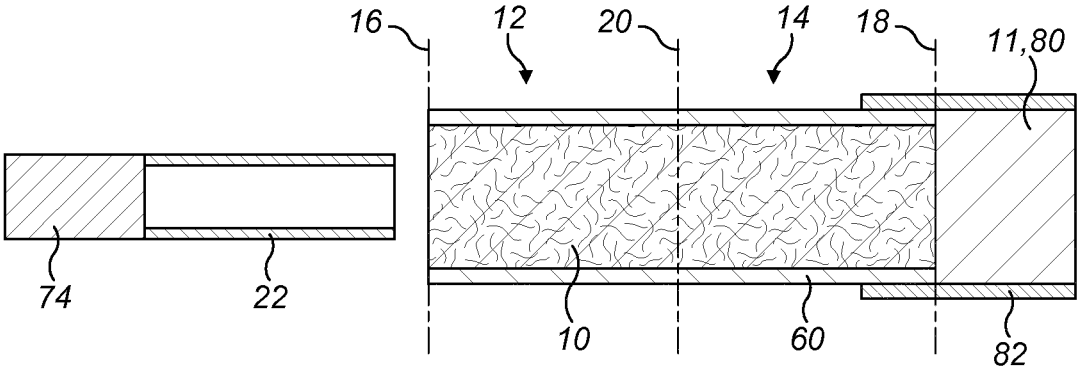
FIGS. 16*a* and 16*b* are diagrammatic illustrations of another apparatus and method for manufacturing the fourth example of the aerosol generating article illustrated in FIGS. 4*a* and 4*b;*
Figure 16B:
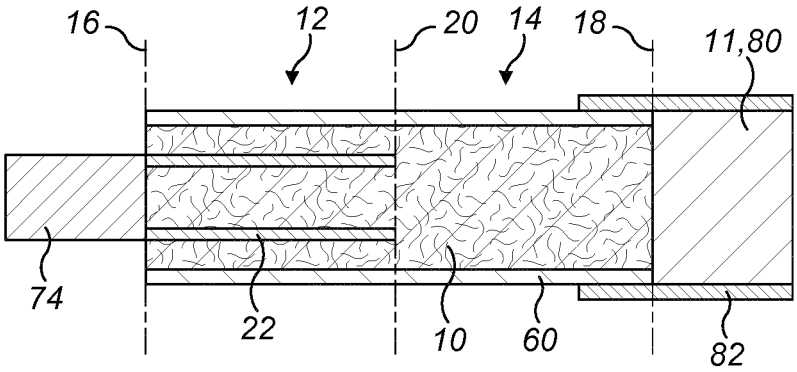
Figure 17:
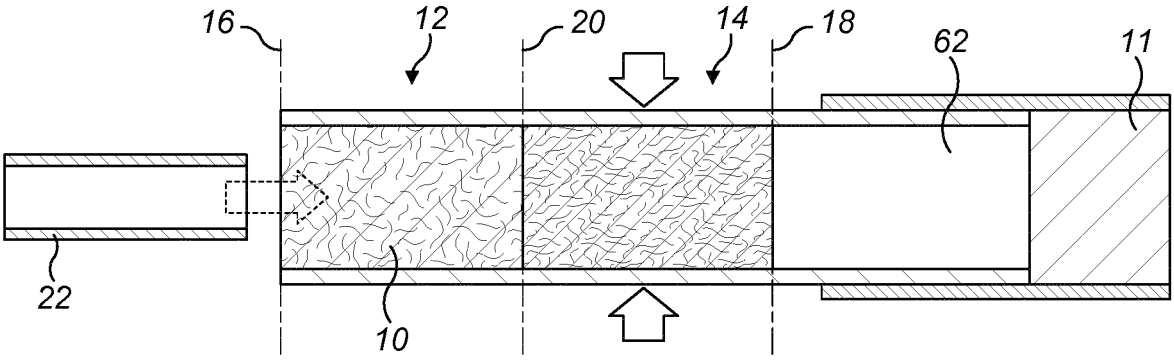
FIGS. 17 and 18 are diagrammatic illustrations of an apparatus and method for manufacturing an aerosol generating article.
Figure 18:
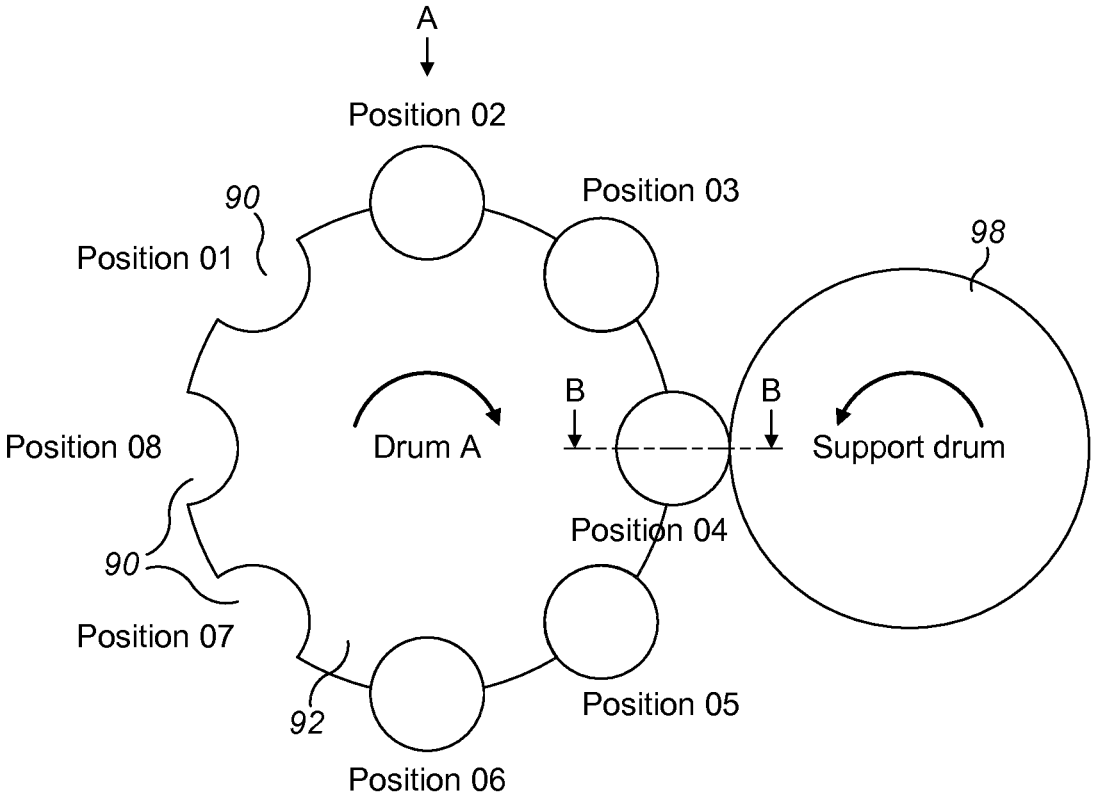

Referring now to FIGS. 16*a* and 16*b*, and in a variation of the embodiments described above with reference to FIGS. 14 and 15, the aerosol generating material 10 can be supported at the second end 18 during insertion of the tubular inductively heatable susceptor 22 into the first region 12 by an integral support member 80. In the embodiment shown in FIGS. 16*a* and 16*b*, the integral support member 80 is constituted by the filter 11 which is secured to the second end 18 of the aerosol generating material 10, for example by tipping paper 82, prior to insertion of the tubular inductively heatable susceptor 22 into the first region 12 from the first end 16.

Referring now to FIGS. 17 to 20, there is shown an apparatus and method for manufacturing an aerosol generating article in which the aerosol generating material 10 in the second region 14 is compressed in a direction (denoted by the arrows in FIG. 17) that is perpendicular to an axis of the aerosol generating material 10 and during insertion of the tubular inductively heatable susceptor 22 into the first region 16.

Referring in particular to FIGS. 18 and 19*a* to 19*c*, the aerosol generating material 10 is positioned in one of a plurality of receiving portions 90, for example grooves, formed around an outer surface of a drum 92. Each receiving portion 90 comprises a first receiving section 94 which corresponds to the position of the first region 12 of the aerosol generating material 10 and which does not compress the aerosol generating material 10 in the first region 12. Each receiving portion 90 also comprises a second receiving section 96 which corresponds to the position of the second region 14 of the aerosol generating material 10 and which compresses the aerosol generating material 10 in the second region 14 during insertion of the inductively heatable susceptor 22 into the first region 12 from the first end 16. The second receiving section 96 can have any suitable geometry, for example as shown in the non-limiting examples of FIGS. 19*a* to 19*c*.

Figure 19A:
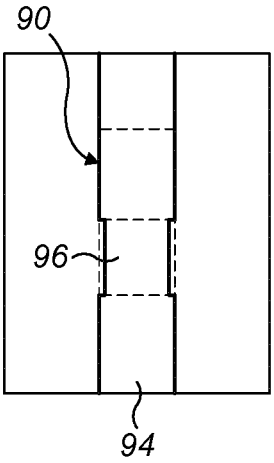
FIGS. 19*a* to 19*c* are views in the direction of arrow A in FIG. 18.
Figure 19B:
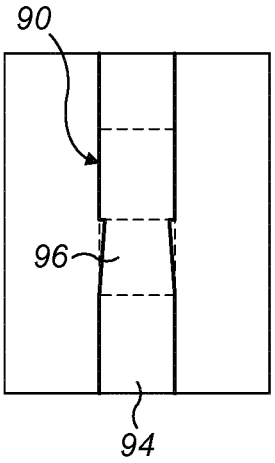
Figure 19C:
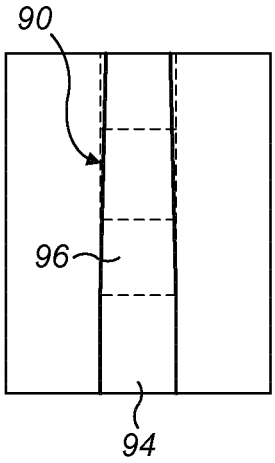
Figure 20A:
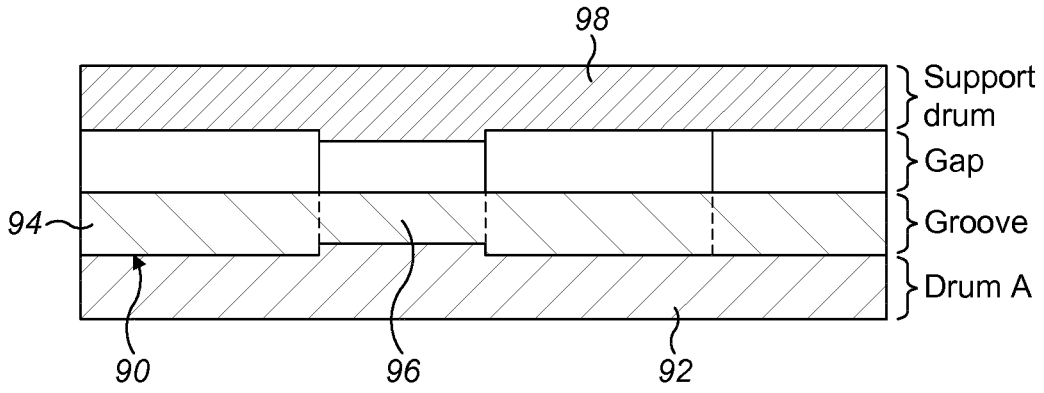
FIGS. 20*a* to 20*c* are cross-sectional views along the line B-B in FIG. 18.
Figure 20B:
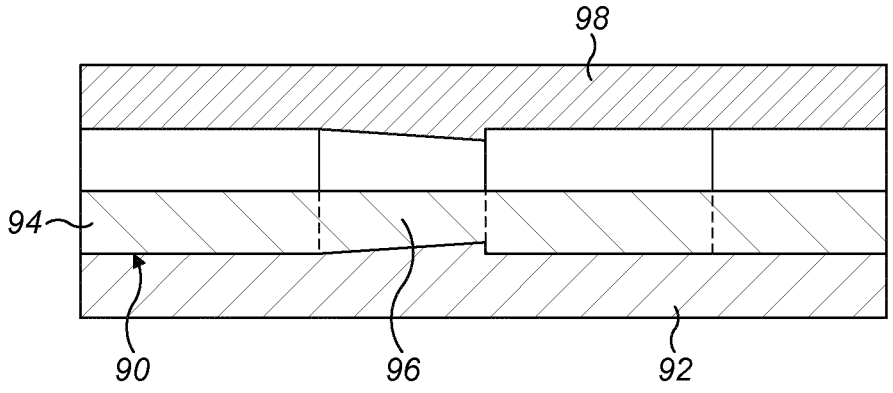
Figure 20C:
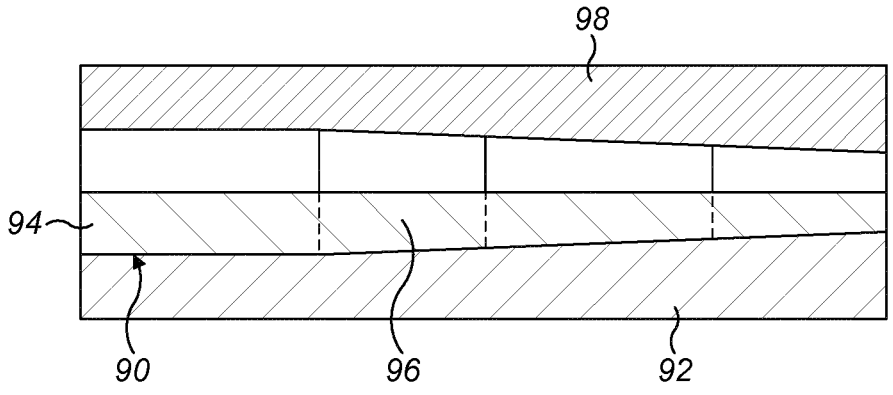

The aerosol generating material 10 is supported in the receiving portion 90 by a support drum 98, for example during insertion of the inductively heatable susceptor 22 into the first region 12 at Position 04. As best seen in FIGS. 20*a* to 20*c*, the support drum 98 has a geometry which conforms to the geometry of the receiving portion 90, for example as shown in FIGS. 19*a* to 19*c*, to ensure that the aerosol generating material 10 is adequately supported in the receiving portion 90, and in particular to ensure that the second region 14 of the aerosol generating material 10 positioned in the second receiving section 96 is adequately compressed during insertion of the inductively heatable susceptor 22 into the first region 12 at Position 04.

Figure 21:
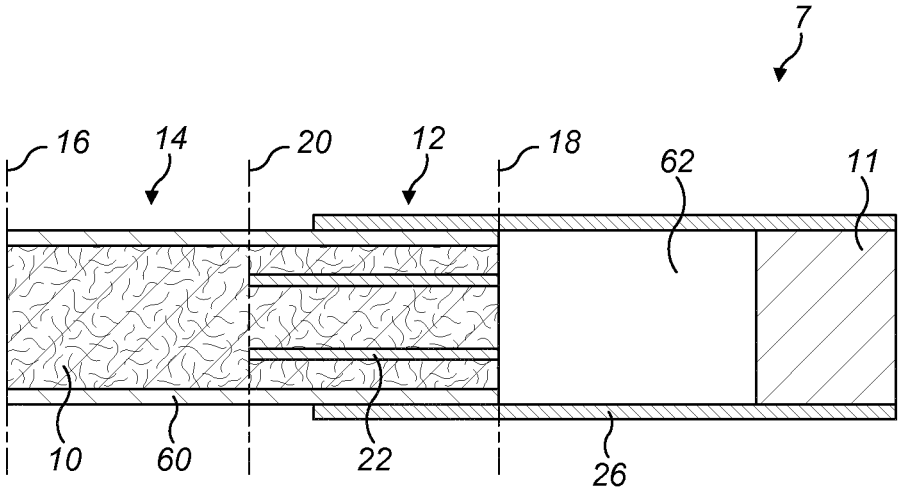
FIG. 21 is a diagrammatic cross-sectional view of a seventh example of an aerosol generating article.

Referring now to FIG. 21, there is shown a seventh example of an aerosol generating article 7 which is similar to the aerosol generating articles described above and in which corresponding elements are designated using the same reference numerals.

The aerosol generating article 7 comprises aerosol generating material 10 having a first region 12 and a second region 14, with the first region 12 being located downstream of the second region 14 relative to an aerosol flow direction within the article 1.

The aerosol generating article 7 comprises an inductively heatable susceptor 22 positioned in the downstream first region 12 and extending from the second end 18 to the intermediate point 20. The inductively heatable susceptor 22 can be tubular as shown in FIG. 21 or can have any other suitable geometry, for example as described above.

The aerosol generating article 1 also comprises a filter 11, for example comprising cellulose acetate fibres, and a hollow tubular member 62 positioned between the second end 18 and the filter 11. The various component parts of the aerosol generating article 7 are wrapped by a sheet of material, for example a paper wrapper 26, to ensure that the component parts are retained in the correct positional relationship.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating article comprising:

aerosol generating material having first and second regions; and an inductively heatable susceptor in the first region, wherein the inductively heatable susceptor is tubular, wherein the aerosol generating material is positioned both inside and outside of the tubular inductively heatable susceptor, and wherein the inductively heatable susceptor includes a sharpened or pointed end.

2. The aerosol generating article according to claim 1, wherein the first region is located upstream of the second region.

3. The aerosol generating article according to claim 2, wherein the first region extends from a first end of the aerosol generating material to an intermediate point between the first end and a second end of the aerosol generating material, the second region extends from the intermediate point to the second end, and the inductively heatable susceptor includes an elongate part which extends from the first end to the intermediate point.

4. The aerosol generating article according to claim 3, wherein an end of the inductively heatable susceptor is flush with the first end or second end of the aerosol generating material or embedded in the first end or second end of the aerosol generating material.

5. The aerosol generating article according to claim 1, wherein the first region is located downstream of the second region.

6. The aerosol generating article according to claim 5, wherein the first region extends from a second end of the aerosol generating material to an intermediate point between the second end and a first end of the aerosol generating material, the second region extends from the intermediate point to the first end, and the inductively heatable susceptor includes an elongate part which extends from the second end to the intermediate point.

7. The aerosol generating article according to claim 1, wherein the inductively heatable susceptor is connected to a sharpened or pointed part comprising a non-inductively heatable material.

8. The aerosol generating article according to claim 1, wherein the aerosol generating material comprises an aerosol generating sheet which is substantially parallel to a longitudinal axis of the aerosol generating article.

9. The aerosol generating article according to claim 1, wherein the inductively heatable susceptor has a length which is greater than a width of the aerosol generating article.

10. An aerosol generating system comprising:

an aerosol generating device comprising an induction coil defining a cavity, the induction coil being configured to generate an alternating electromagnetic field; and the aerosol generating article according to claim 1 positioned in the cavity so that a longitudinal axis of the inductively heatable susceptor is substantially aligned with a longitudinal axis of the cavity.

11. The aerosol generating article according to claim 1, wherein the inductively heatable susceptor is connected to a sharpened or pointed part comprising a material which is substantially non-electrically conductive and non-magnetically permeable.

12. A method for manufacturing an aerosol generating article comprising aerosol generating material having first and second regions, the method comprising positioning a tubular inductively heatable susceptor in the first region so that the aerosol generating material is positioned both inside and outside of the tubular inductively heatable susceptor, wherein the aerosol generating material comprises a first end, a second end and an intermediate point between the first and second ends, the method comprising inserting the inductively heatable susceptor into the first region from the first end or the second end so that it extends to the intermediate point and supporting the aerosol generating material at the opposite one of the first and second ends during insertion of the inductively heatable susceptor into the first region.

13. The method according to claim 12, wherein the first region is located upstream of the second region, the first region extends from a first end of the aerosol generating material to an intermediate point between the first end and a second end of the aerosol generating material, the second region extends from the intermediate point to the second end, and the inductively heatable susceptor is tubular, the method comprising inserting the tubular inductively heatable susceptor into the first region from the first end so that it extends from the first end to the intermediate point.

14. The method according to claim 13, wherein the method comprises inserting the tubular inductively heatable susceptor into the first region by a pusher, the pusher having a tapered part which can be partially inserted into an end of the tubular inductively heatable susceptor.

15. The method according to claim 12, wherein the first region is located downstream of the second region, the first region extends from a second end of the aerosol generating material to an intermediate point between the second end and a first end of the aerosol generating material, the second region extends from the intermediate point to the first end, and the inductively heatable susceptor is tubular, the method comprising inserting the tubular inductively heatable susceptor into the first region from the second end so that it extends from the second end to the intermediate point.

16. The method according to claim 12, wherein the aerosol generating material in the second region is compressed in a direction perpendicular to an axis of the aerosol generating material or a direction of insertion during insertion of the inductively heatable susceptor into the first region.

17. A method for manufacturing an aerosol generating article comprising aerosol generating material having first and second regions, the method comprising positioning an inductively heatable susceptor in the first region, wherein the first region is located upstream of the second region, the first region extends from a first end of the aerosol generating material to an intermediate point between the first end and a second end of the aerosol generating material, the second region extends from the intermediate point to the second end, and the inductively heatable susceptor is tubular, the method comprising inserting the tubular inductively heatable susceptor into the first region from the first end so that it extends from the first end to the intermediate point, and wherein the method comprises inserting the tubular inductively heatable susceptor into the first region by a pusher, the pusher having a tapered part which can be partially inserted into an end of the tubular inductively heatable susceptor.

* * * * *